United States Patent [19]

Solomon et al.

[11] 4,139,375

[45] Feb. 13, 1979

[54] PROCESS FOR SINTERING POWDER METAL PARTS

[75] Inventors: Jack Solomon, Rye; Thomas F. Kinneman, Peekskill, both of N.Y.

[73] Assignee: Union Carbide Corporation, New York, N.Y.

[21] Appl. No.: 875,615

[22] Filed: Feb. 6, 1978

[51] Int. Cl.[2] ..... B22F 3/00

[52] U.S. Cl. ..... 75/224; 148/16.7; 148/20.3; 148/126

[58] Field of Search ..... 75/224; 148/16.7, 20.3, 148/126

[56] References Cited

U.S. PATENT DOCUMENTS

| | | | |
|---|---|---|---|
| 2,673,821 | 3/1954 | Stutzman | 148/16.7 |
| 3,891,473 | 6/1975 | Latua | 75/224 |

*Primary Examiner*—Brooks H. Hunt
*Attorney, Agent, or Firm*—Saul R. Bresch

[57] ABSTRACT

In a process for sintering powder metal parts comprising:

(a) passing the parts through a furnace adapted therefor from its upstream end to its downstream end, said furnace having two successive zones, an upstream zone, which is maintained at a temperature in the range of about 800° F to about 2200° F and a cooling zone, said furnace further having an atmosphere therein comprising carbon monoxide, hydrogen, carbon dioxide, water and nitrogen distributed throughout the zones;

(b) permitting the parts to reside in the upstream zone for a sufficient length of time to cause sintering; and (c) removing the sintered parts from the furnace, the improvement comprising: introducing a mixture consisting essentially of methanol and nitrogen into the upstream zone at a point where a temperature of at least about 1500° F is maintaied, the methanol and nitrogen being in a ratio sufficient to provide, when subjected to such temperature, an atmosphere comprising, in percent by volume, about 1 to about 20 percent carbon monoxide; and about 1 to about 40 percent hydrogen; and balance nitrogen.

3 Claims, 1 Drawing Figure

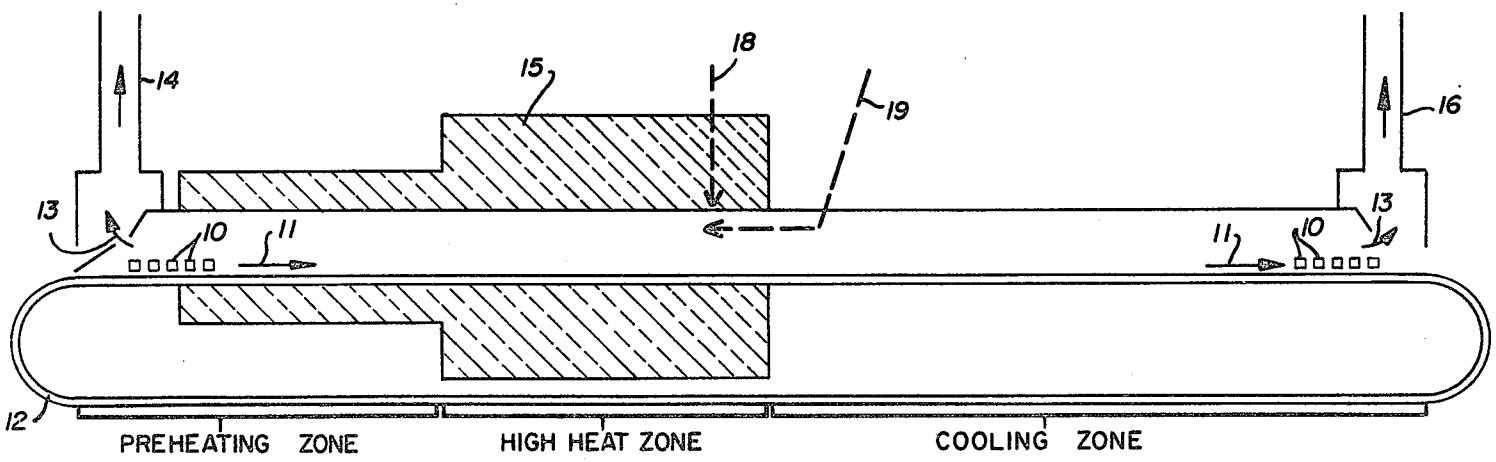
16
13
10
11
19
18
15
14
13
10
11
12
COOLING ZONE
HIGH HEAT ZONE
PREHEATING ZONE

PROCESS FOR SINTERING POWDER METAL PARTS

FIELD OF THE INVENTION

This invention relates to the sintering of powder metal parts, particularly where the parts are passed through a furnace adapted therefor.

DESCRIPTION OF THE PRIOR ART

The sintering of compacted powder metal has been carried out for many years to provide industry with a myriad of parts of various shapes and sizes for use in untold numbers of machines, in construction, and in other everyday articles of commerce.

Powder metal parts are made by compacting metal powders having typical mesh sizes of about 150 to about 325 into a desired shape and then sintering at high temperatures in a controlled atmosphere. A discussion of the art of powder metallurgy including a description of the powders, how they are compacted or consolidated, and the lubricants used in compacting may be found in "Kirk-Othmer Encyclopedia of Chemical Technology", 2nd edition, 1968, John Wiley & Sons, Inc., New York, section entitled "Powder Metallurgy", particularly pages 401 to 415, which pages are incorporated by reference herein. Metals used to provide the powders for compacting, can be iron, carbon steel, stainless steel, copper, brass, aluminum, other iron and steel alloys, or other metals and metal alloys. After they are compacted, the parts are typically introduced into an open-ended continuous furnace having mesh belts or other means for carrying the parts through the furnace. The parts pass downstream successively through a preheating zone, a high heat zone and a cooling zone; atmosphere is introduced towards the center of the furnace from the cooling zone and flows out both ends of the furnace; and the parts are subjected to the changing temperature profile in a controlled atmosphere for about 30 to about 120 minutes in toto and about 15 to about 60 minutes in the preheat and high heat zones. Other types of furnaces may be used such as batch, pusher type, or roller hearth furnaces, but the typical regimen remains the same, i.e., treatment of the parts in successive preheat, high heat, and cooling zones under controlled atmosphere for residence times sufficient to complete the sintering, which is sometimes defined as a partial welding together of the powder metal particles at temperatures below the melting point of the metal to produce greater strength, conductivity, and density. Some of the furnaces used are of the muffle type and others are refractory furnaces, again with little change in the conventional procedure. It should be pointed out that in some furnaces there is no preheating zone, and in some the temperatures of the preheating zone and the high heat zone overlap. The cooling zone is an area where no external heat is added; however, it will be understood that hot metal parts passing from the high heat zone heat the upstream end of the cooling zone although the declining temperature profile of the cooling zone is not changed thereby.

Up to this time, different sources of atmosphere have been and still are being used industrially for powder metal sintering, e.g., endo gas and dissociated ammonia, while other atmosphere sources, e.g., purified exo gas, nitrogen, and methanol or other higher alcohols, have been suggested.

The atmosphere performs three functions in powder metal sintering: (i) it carries pressing lubricants out the front end of the furnace; (ii) it prevents oxidation of parts; and (iii) it reduces the surface oxide layer to promote sintering. In parts containing medium or high carbon concentrations (greater than 0.2 percent by weight), the atmosphere carries out a further function, i.e., that of maintaining the carbon concentration, to assure no essential loss of part properties.

Endo gas is commonly used in sintering iron and steel powder metal parts. Industrially, the endo gas is prepared in a gas generator by the reaction of air with natural gas (or propane). These gas or endo generator(s) operate independently from the furnace, and are most reliable when their output flow rate is essentially constant. The reaction of air and natural gas yields a mixture of primarily carbon monoxide, hydrogen, and nitrogen, and this mixture is referred to as endo gas. A typical endo gas composition where the endo gas is made from natural gas is (by volume) about 20 to 23 percent carbon monoxide; about 30 to 40 percent hydrogen; about 40 to 47 percent nitrogen; about 1 percent water vapor; and about 0.5 percent carbon dioxide, the composition of the endo gas varying with the composition of the natural gas used to provide it.

When endo gas is used in the sintering of high carbon parts, the addition of enriching gas such as methane or propane is required to maintain carbon in the parts for without enriching gas, the carbon dioxide and water vapor in the endo gas will decarburize the part. Further, the endo gas atmosphere cannot of itself be in equilibrium with the parts throughout the entire sintering temperature range. The important reactions are:

$$2\,CO \rightleftarrows C + CO_2 \quad (1)$$

$$CO + H_2 \rightleftarrows C + H_2O \quad (2)$$

$$CH_4 \rightarrow C + 2H_2 \quad (3)$$

The equilibrium reactions are (1) and (2) and reaction (3) is the rate limited decomposition of methane. In practice, at high temperatures, reactions (1) and (2) decarburize and reaction (3) carburizes the part. At lower temperatures, all three reactions carburize the part. The balance between the decarburizing and carburizing reactions is a function of many sintering variables, e.g., oxide in the part, air infiltration rate, atmosphere flow rate, and carbon concentration in the part. To achieve this balance, the amount of enriching gas is varied.

Dissociated ammonia is used in the powder metal sintering of stainless steel parts, and some iron, copper, and brass parts depending on their compositions and is of limited rather than general application.

In regard to the suggestion to use purified exo gas as a sintering atmosphere for iron and steel parts: the carbon dioxide and water vapor are removed from the exo gas by solid adsorption (with molecular sieves or other adsorbents) or by liquid absorption of carbon dioxide followed by the use of a drying agent to provide the purified exo gas typically having a composition of about 1 to about 10 percent carbon monoxide, about 1 to about 10 percent hydrogen, balance nitrogen, and less than about 0.1 percent carbon dioxide and a dew point of about minus 40° F. In the furnace, this purified gas will not decarburize the part because the low levels of carbon dioxide and water vapor greatly reduce the rate of reactions (1) and (2), set forth above. Therefore, in a properly operating sintering furnace, no methane enriching gas need be added to the purified exo gas. Consequently the atmosphere will be low in carbon dioxide, water vapor, and methane thus minimizing both carburizing and decarburizing reactions and giving more positive carbon control.

This characteristic of purified exo gas is advantageous in furnaces, which are partly constructed of high nickel alloys, e.g., furnaces having high nickel alloy belts and muffles. This alloy deteriorates in a carburizing atmosphere. When enriching gas is added to an endo gas sintering atmosphere, the normal alloy lifetime of about one to two years is shortened to as little as three months. However, if purified exo gas without enriching gas is used as the sintering atmosphere, alloy lifetime is lengthened.

The drawbacks of purified exo gas lie in its current mode of production. It is generally made in a generator-purifier train which produces atmosphere for several furnaces. Since different metal parts have different requirements with respect to carbon protection or oxide reduction, for example, it follows that different amounts of carbon monoxide and hydrogen may be required in the sintering atmosphere. This variation of carbon monoxide and hydrogen amounts is not possible where several furnaces are supplied by only one generator. The addition of enriching gas, e.g., in the endo gas sintering atmosphere, provides the flexibility to accommodate the varying metal parts requirements, but at the cost of the advantage observed for an enriching gas-free exo gas atmosphere.

Further, the purifier train is a chemical purification plant, which, naturally, has maintenance and operating problems. Since most powder metal sinterers use relatively small amounts of atmosphere, the operation of a generator-purifier train can be very expensive per atmosphere volume especially since a failure in any part of the train could shut down several furnaces.

Other disadvantages, common to both endo and exo gas, are that they are made from natural gas, which has recently been in short supply causing the shut down of sintering furnaces. As if unavailability of natural gas supply were not enough, natural gas composition has become unreliable causing variations in endo gas composition and resulting in poor part properties.

Nitrogen, an atmosphere frequently used for sintering aluminum parts, is also a suggested alternative, but, as has been previously noted, carbon sources and reducing agents are needed to protect carbon concentration and to reduce surface oxides. The addition of natural gas or other hydrocarbons to the nitrogen can, of course, be undertaken to overcome this problem, but control of carbon then becomes difficult since reaction (3), above, is rate limited and this rate or rates must be balanced with the rate of oxide reduction, the reaction with air and other oxygen sources. In addition, the hydrocarbon additive has all of the disadvantages mentioned above for the enriching gas and while hydrogen can be introduced as a reducing agent, it is expensive and does not protect carbon.

Finally, methanol and other alcohols have been suggested as a source of powder metal sintering atmospheres; however, an essentially pure methanol derived atmosphere has high carbon monoxide and hydrogen contents and can form significant amounts of methane, which raises a problem similar to that found where endo gas is the source of the atmosphere.

From the foregoing discussion of the problems of using endo gas, exo gas, dissociated ammonia, nitrogen, or various alcohols in providing atmospheres for known powder metal sintering processes, it becomes apparent that there is a need to improve on these processes by providing an atmosphere, which (i) is not based on natural gas; (ii) neither carburizes nor decarburizes the powder metal parts; (iii) is sufficiently flexible to handle metal parts with different carbon levels or other characteristics in various powder metal sintering furnaces.

SUMMARY OF THE INVENTION

An objective of this invention, therefore, is to fill the need recited above by providing an improvement in a known powder metal sintering process wherein the atmosphere is derived from such a source and in such a manner that requirements for natural gas are eliminated, requirements for enriching gas are either eliminated entirely or substantially reduced, and process versatility is achieved.

Other objects and advantages will become apparent hereinafter.

According to the invention, such an improvement has been discovered in a process for sintering powder metal parts comprising the following steps:

(a) passing the parts through a furnace adapted therefor from its upstream end to its downstream end, said furnace having two successive zones, an upstream zone, which is maintained at a temperature in the range of about 800° F. to about 2200° F. and a cooling zone, said furnace further having an atmosphere therein comprising carbon monoxide, hydrogen, carbon dioxide, water and nitrogen distributed throughout the zones;

(b) permitting the parts to reside in the upstream zone for a sufficient length of time to cause sintering; and (c) removing the sintered parts from the furnace.

The improvement comprises:

introducing a mixture consisting essentially of methanol and nitrogen into the upstream zone at a point where a temperature of at least about 1500° F. is maintained, the methanol and nitrogen being in a ratio sufficient to provide, when subjected to such temperature, an atmosphere comprising in percent by volume, about 1 to about 20 percent carbon monoxide; about 1 to about 40 percent hydrogen; and balance nitrogen.

BRIEF DESCRIPTION OF THE DRAWING

The sole FIGURE of the drawing is a schematic diagram of a side view of an open-ended continuous powder metal sintering furnace in which the process of the invention may be carried out.

DESCRIPTION OF THE PREFERRED EMBODIMENT

Referring to the drawing:

Conventional powder metal parts 10 are placed on conveyor belt 12, which can be made of an alloy mesh or of other material and construction capable of withstanding the furnace heat, e.g., an alloy containing approximately 76 percent nickel, 16 percent chromium, and 6 percent iron. Belt 12 is activated and parts 10 pass in the direction of arrow 11 through the furnace, also of conventional construction. Simultaneously with or before belt activation, the source, from which the furnace atmosphere is derived, is introduced. The source is a mixture consisting essentially of nitrogen and methanol.

The methanol is either anhydrous or a commercial grade containing no more than about 0.5 percent by weight water and preferably less than about 0.25 percent. The methanol, through heating, dissociates into various vaporous compounds, which, together, with the nitrogen make up the furnace atmosphere. The inlet flow rate together with the heat and the placement of the inlet are sufficient to drive the atmosphere out both ends of the furnace following arrows 13 up vents 14 and 16. It will be understood by those skilled in the art that the composition of the atmosphere changes somewhat as it passes through the furnace.

Parts 10 first pass through a preheating zone wherein the temperature is in the range of about 800° F. to about 2200° F. and is usually in the range of about 1200° F. to about 1800° F. The residence time for parts 10 in this zone may be about 5 to about 60 minutes. The zone is surrounded by insulation 15, and it will be observed from the drawing that the insulation surrounding the preheating zone is not as thick as that surrounding the high heat zone. Parts 10 then move through a high heat zone wherein the temperature is in the range of about 1900° F. to about 2200° F. and is usually in the range of about 2000° F. to about 2100° F. The residence time for the parts in the high heat zone may be about 5 to about 60 minutes and is usually about 10 to about 15 minutes. Insulation 15 is made of conventional materials. In a typical furnace, the preheating zone and the high heat zone are each about the same length, about 5 to about 15 feet. A common length is about ten feet. It follows that the residence time in the two zones is the same as the belt moves at a constant speed. The preheating zone and the high heat zone are referred to in this specification collectively as the "upstream zone" since, as pointed out above, in some operations there is no preheating zone and, in others, the temperature ranges overlap. From the upstream zone, parts 10 pass downstream into a "cooling zone3", usually water cooled. Other conventional cooling or quenching devices can be used, however. The temperature in this zone is about 2000° F. to ambient; the residence time may be about 10 to about 120 minutes and is usually about 20 to about 30 minutes; and the length of the zone is typically about 10 to about 30 feet, a common length being 20 feet where 10 foot lengths are availed of in the preceding zones.

In prior art furnaces, the source of the atmosphere is introduced at the upstream end of the downstream zone. In the present invention, however, the source from which the atmosphere is derived, i.e., the mixture consisting essentially of nitrogen and methanol, is introduced, e.g., through inlet pipe 18 or inlet pipe 19 directly into the upstream zone (the arrowhead represents the point of introduction). The point of introduction is a point in the upstream zone where a temperature of at least about 1500° F. is maintained during the period of introduction. This point can be measured by the use of a thermocouple, which will monitor the point throughout the period of introduction of the nitrogen-methanol mixture. A sufficient amount of each of the components of the mixture is introduced to provide when subjected to such temperature, an atmosphere comprising, in percent by volume, about 1 to about 20 percent carbon monoxide; about 1 to about 40 percent hydrogen; less than about 0.5 percent carbon dioxide; less than about 1.25 percent water vapor; and the balance nitrogen for a total of 100 percent. The ratio of nitrogen to methanol in the mixture is about 1.5 to about 100 parts by volume of nitrogen per part by volume of methanol in the vapor state. It will be apparent that the relative flows of nitrogen and methanol control the concentration of carbon monoxide and hydrogen in the atmosphere. In the case of high carbon parts (0.6 to 1 percent by weight carbon), the suggested ratio is about 1.5 to about 10, preferably about 2 to about 5, parts by volume of nitrogen per part by volume of methanol in the vapor state and for low carbon parts (less than 0.6 percent by weight carbon), the suggested ratio is about 10 to about 100, preferably about 10 to about 15.

The decomposition or dissociation of methanol in the upstream zone proceeds according to the following reactions:

$$CH_3OH \rightarrow CO + 2H_2 \quad (4)$$

$$CH_3OH \rightarrow C + H_2 + H_2O \quad (5)$$

$$2CH_3OH \rightarrow CH_4 + CO_2 + 2H_2 \quad (6)$$

The principal reaction is reaction (4) and it is very important that reactions (5) and (6) be minimized for these reactions are deleterious to the sintering process because of their net decarburizing effect. Further, reaction (6) produces methane, which, as noted above, one would prefer to avoid.

In subject process, the methanol may be introduced by dripping it into the furnace or through the use of an atomizing nozzle which sprays droplets into the furnace. In any case, the manner of introduction is such that the temperature of the methanol rapidly rises to at least about 1500° F., the methanol being so diluted in nitrogen that bimolecular reaction (6) occurs at a lower rate.

To accomplish the rapid increase in temperature, the inlet pipe can also be extended along the roof of the furnace chamber into the upstream zone as inlet pipe 19. Such a pipe would have to be supported to prevent sag and made of high temperature resistant materials, a requirement of any inlet pipe used in the instant process. The inlet pipe may be designed to sparge the methanol transverse to the furnace axis, which axis is about parallel to belt 12. An alternative is to extend the inlet pipe along the floor of the furnace chamber into the upstream zone.

Another alternative is to pass the inlet pipe through the wall of the furnace and insulation 15 directly into the upstream zone as inlet pipe 18.

A typical atmosphere produced by subject process is, by volume, 6 percent carbon monoxide; 12 percent hydrogen; 0.02 percent carbon dioxide; 0.15 percent water vapor; and balance nitrogen. Such an atmosphere protects carbon concentration, eliminates surface decarburization, and does not carburize those alloys used in the furnace construction such as the previously mentioned belts and muffles.

In certain cases, particularly where the sintering furnace is refractory based or where the design of the furnace is atypical, it may be necessary to add some enriching gas to keep the water vapor and carbon dioxide within the defined limits, i.e., less than about 0.5 percent carbon dioxide and less than about 1.25 percent water vapor. Suggested amounts of enriching gas, e.g., methane or other hydrocarbons, to be introduced into the atmosphere are in the range of about 1 to about 10 percent by volume based on the total volume of the atmosphere. Such a situation will, of course, not be as beneficial as a process where enriching gas is not added, and running the process in refractory-lined or atypical furnaces is not a preferred mode of carrying out the invention. It may also be desirable to introduce additional nitrogen at the upstream end of the upstream zone to block oxygen entry. This addition will change the composition of the atmosphere minimally, i.e., less than about 5 percent by volume, because most of the nitrogen will go out the upstream end of the furnace.

The sintered powder metal parts are removed from the downstream end of the furnace and handled in a conventional manner. A determination as to whether the sintering is complete and whether the integrity of the composition has been maintained is made by conventional analysis techniques.

The benefits of subject process over sintering processes using endo or exo gas, dissociated ammonia, nitrogen, or various alcohols include the following: (i) some parts sinter more rapidly in the instant process than in endo gas; (ii) the sintered parts are brighter, more metallic looking; (iii) surface decarburization is essentially eliminated; (iv) carbon control and size control are reliable, i.e., control is no longer dependent upon natural gas composition and endo generator problems, but on the process per se; and (v) longer alloy life, i.e., the alloys used in the construction of the furnace.

The following examples illustrate the invention:

EXAMPLE 1

A sintering furnace as described in the specification and the drawing is used to sinter high carbon steel powder metal parts. The amount of carbon in the steel is about 1.0 percent by weight.

The average temperature in the preheating zone is 2100° F., the lowest temperature in the zone being 1600° F.; the residence time is 48 minutes; and the length of the zone is 10 feet.

The average temperature in the high heat zone is 2100° F., the lowest temperature in the zone being 1900° F.; the residence time is 48 minutes; and the length of the zone is 10 feet.

The temperature in the cooling zone runs from about 2000° F. at the upstream end of the cooling zone to 70° F. at the downstream end; the residence time is 96 minutes, and the length of the zone is 20 feet.

Two sets of parts are run through the furnace at various belt speeds.

The source of the atmosphere for one set of parts is endo gas plus enriching gas. The gases are introduced through an inlet at the upstream end of the downstream zone and the composition of the atmosphere is, in percent by volume: 20 percent CO, 40 percent $H_2$, 1.4 percent $CO_2$, 1.6 percent $H_2O$, 0.6 percent $CH_4$, balance $N_2$.

The source of the atmosphere for a second like set of parts is a mixture consisting essentially of 14 parts by volume nitrogen and 1 part by volume methanol (in vapor state). The mixture is fed through inlet pipe 18. The composition of the atmosphere is, in percent by volume, about 6 percent CO, 12 percent $H_2$, 0.02 percent $CO_2$, 0.15 percent $H_2O$, balance $N_2$.

The results are as follows:

| Part | Belt Speed (inches per minute) Atmosphere Source: Endo | Belt Speed (inches per minute) Atmosphere Source: $CH_3OH/N_2$ | Percent Production Increase |
|---|---|---|---|
| gear | 2.5 | 4.0 | 60 |
| bearing gear | 5.0 | 8.0 | 60 |

-continued

| Part | Belt Speed (inches per minute) Atmosphere Source: Endo | Belt Speed (inches per minute) Atmosphere Source: $CH_3OH/N_2$ | Percent Production Increase |
|---|---|---|---|
| (copper infiltrated) | 2.8 | 3.8 | 36 |

Production increase is based on increase in belt speed. Note that to achieve the production increase, the belt is moved more rapidly using subject process.

EXAMPLE 2

Example 1 is repeated for the first gear using the $CH_3OH/N_2$ source in two runs. The mixture of $CH_3OH/N_2$ consists essentially of 2 parts by volume nitrogen and 1 part by volume methanol (in vapor state). In the first run, the mixture is introduced at the upstream end of the cooling zone and in the second run through a line into the high heat zone (inlet pipe 18).

| Run | $N_2$ flow (in cubic feet per hour) | Methanol flow (gallon per hour) | Atmosphere (volume percent) (balance $N_2$ and $H_2$): CO | $CO_2$ | $H_2O$ |
|---|---|---|---|---|---|
| 1 | 80 | 0.51 | 7 | 0.10 | >2.3 |
| 2 | 80 | 0.51 | 22.5 | 0.19 | 0.99 |

The water content is about ambient dew point when introduction is made in Run 1. The CO and $CO_2$ are low in Run 1 indicating carbon formation in the furnace. Run 2 shows that introduction into the high heat zone gives the expected CO concentration and satisfactory $CO_2$ and $H_2O$ concentrations.

EXAMPLE 3

Example 2 (Run 2) is repeated except that the ratio of nitrogen to methanol is varied and the high heat zone temperature at point of introduction is maintained at 2100° F. The ratios and atmosphere are as follows:

| Run | Ratio of $N_2$:$CH_3OH$ (by volume)* | atmosphere (volume percent) (balance $N_2$, $H_2$, $CH_4$): CO | $CO_2$ | $CH_4$ |
|---|---|---|---|---|
| 1 | 2:1 | 22.5 | 0.19 | 0.99 |
| 2 | 4:1 | 11.8 | 0.09 | 0.45 |
| 3 | 8:1 | 6.0 | 0.025 | 0.15 |

*value is for methanol in vapor state

I claim:

1. In a process for sintering powder metal parts comprising:

(a) passing the parts through a furnace adapted therefor from its upstream end to its downstream end, said furnace having two successive zones, an upstream zone, which is maintained at a temperature in the range of about 800° F. to about 2200° F. and a cooling zone, said furnace further having an atmosphere therein comprising carbon monoxide, hydrogen, carbon dioxide, water and nitrogen distributed throughout the zones;

(b) permitting the parts to reside in the upsteam zone for a sufficient length of time to cause sintering; and (c) removing the sintered parts from the furnace, the improvement comprising:

introducing a mixture consisting essentially of methanol and nitrogen into the upstream zone at a point where a temperature of at least about 1500° F. is maintained, the methanol and nitrogen being in a ratio sufficient to provide, when subjected to such temperature, an atmosphere comprising, in percent by volume, about 1 to about 20 percent carbon monoxide; about 1 to about 40 percent hydrogen; and balance nitrogen.

2. The process defined in claim 1 wherein the ratio of nitrogen to methanol is in the range of about 1.5 to about 100 parts by volume of nitrogen per part by volume of methanol in the vapor state.

3. The process defined in claim 2 wherein the residence time of the parts in the upstream zone is about 10 minutes to about 120 minutes.

* * * * *